US005568175A

United States Patent [19]

Suh et al.

[11] Patent Number: 5,568,175

[45] Date of Patent: Oct. 22, 1996

[54] THERMAL PRINT HEAD

[75] Inventors: Suhn-Ji Suh; Hong-Geun Yang, both of Seoul, Rep. of Korea

[73] Assignee: Samsung Electronics Co., Ltd., Suwon, Rep. of Korea

[21] Appl. No.: 554,338

[22] Filed: Nov. 6, 1995

[30] Foreign Application Priority Data

Jun. 21, 1995 [KR] Rep. of Korea ..... 95-16688

[51] Int. Cl.[6] ..... B41J 2/335; B41J 2/34

[52] U.S. Cl. ..... 347/200; 347/205

[58] Field of Search ..... 347/200, 201, 347/205, 209

[56] References Cited

U.S. PATENT DOCUMENTS 5,285,216 2/1994 Ota et al. ..... 347/209

*Primary Examiner*—Huan H. Tran

[57] ABSTRACT

A thermal print head, including a resistance substrate having a front and rear surface, a plurality of heating elements formed on the front surface of the resistance substrate for converting electrical energy into heat energy, a cooling board for dissipating heat generated from the heating elements and the resistance substrate, wherein the cooling board is divided into separable first and second parts, the first part being disposed opposite the rear surface of the resistance substrate and below the heating elements; and a cooling compound with high thermal conductivity inserted between the first part of the cooling board and the rear surface of the resistance substrate.

14 Claims, 2 Drawing Sheets

THERMAL PRINT HEAD

BACKGROUND OF THE INVENTION

A. Field of the Invention

The present invention relates to a thermal prim head. More particularly, the present invention relates to a thermal print head in which a cooling board is divided into two regions.

B. Description of the Prior Art

Thermal recording is a technique by which characters or graphics are recorded onto thermal paper. In thermal recording, only heated portions of white thermal paper are darkened into black portions. By regulating the portions of the thermal paper that are heated, the desired characters or graphics can be placed on the thermal paper. A thermal printer is a machine to which the above-mentioned technique of thermal recording is applied. A thermal printer uses a thermal print head on which heating elements for converting electrical energy into heat energy are formed in a line. Each heating element in the line forms a dot on the paper when it is heated.

When a user prints characters or graphics using the thermal printer, the heating elements are selectively heated to generate heat based on data inputted as an electrical signal while the thermal print head contacts a medium such as the thermal paper. The generated heat is applied to the thermal paper to record the characters or graphics as a series of dots. The image is formed by sequentially applying lines of data, i.e., heated dots, to the thermal paper.

A conventional thermal print head will be described in detail below with reference to the accompanying drawings.

FIG. 1 is a sectional view of the conventional thermal print head, and FIG. 2 is a perspective view illustrating a portion corresponding to a reference number, 10. Referring to FIG. 1, the conventional thermal print head comprises a resistance substrate 1, a plurality of heating elements 2, a driving integrated circuit 21, and a driving substrate 30. The resistance substrate 1 is made of ceramics or the like and has the plurality of heating elements 2 formed on a front surface. Each of the plurality of heating elements 2 generates heat when current flows through it. The driving integrated circuit 21 is formed on the driving substrate 30 and separately drives the resistance substrate 1 and the heating elements 2.

Referring to FIG. 2, the heating elements 2 are linearly formed in a predetermined direction like dots. They are driven and heated selectively and generate heat to the thermal paper. A cooling board 3 is adhered to a rear surface of the resistance substrate 1 by an adhesive 4. The cooling board 3 is made of metal with high thermal conductivity to effectively dissipate heat generated by the heating elements 2. A part of the cooling board 3 is connected to a part of the driving substrate 30 by the adhesive 4, thereby supporting the driving substrate 30. A connector 40 is then supports the remainder of the driving substrate 30.

A protector 22 protects the driving integrated circuit 21 by covering the driving integrated circuit 21. A cover 20 further protects the driving integrated circuit by covering over the protector 22. The cover 20 is attached to the driving substrate 30 by a screw 50.

In operation, when the thermal print head is used at room temperature, the surface temperature of the resistance substrate 1 can reach 200° C. because of the heat generated from the heating elements 2. Accordingly the printer must dissipate any excess heat that does not contribute to printing or it will adversely influence printing jobs performed by the printer. When heat dissipation has not been performed efficiently, the undissipated heat causes uneven contrast in the current printing job.

To solve this problem, the cooling board 3, which is made of a metal with a high thermal conductivity, is attached to the rear surface of the resistance substrate 1 to enhance dissipation of excess heat generated by the heating elements 2.

Generally, double-sided tape is used as the adhesive 4 to attach the cooling board 3 to the resistance substrate 1. Double-sided tape is used because the resistance substrate 1 and the cooling board 3 differ significantly in their coefficients of thermal expansion. If the resistance substrate 1 and the cooling board 3 were fixed directly, they would be warped by the heat during printing in the same way that a bimetal is warped by changes in its ambient temperature. The use of double sided tape reduces the stress caused by the difference of the coefficients of thermal expansion of the resistance substrate 1 and the cooling board 3 and thereby prevents warping of the resistance substrate 1. In addition, using double-sided tape also simplifies production of the printer by making it easier to join the cooling board 3 to the resistance substrate 1.

Double-sided tape is not without its problems, however. When the resistance substrate 1 and the cooling board 3 are joined by double-sided tape, heat generated by the resistance substrate 1 is not sufficiently dissipated into the cooling board 3. This occurs because the thermal conductivity of the double-sided tape is generally small, for example, less than $0.5\times10^{-3}$ cal/cm-sec-°C. The incomplete heat dissipation caused by using the double-sided tape can result in uneven contrast and smearing of the printed image because too much heat may remain in the resistance substrate 1. Accordingly, the double-sided tape cannot be used in high speed printers, color printers, high speed label printers, and the like, which require greater heat dissipation.

To overcome the above-mentioned disadvantage, a cooling compound on the principal plane of the resistance substrate 1 can be used in place of the adhesive 4. Unfortunately, the thickness of the cooling compound can differ locally along the resistance substrate 1 because the manufacturing process results in areas having a difference in height on the order of tens to hundreds of microns. The uneven thickness in turn causes uneven cooling and therefore uneven contrast in the printed image.

A technique has been proposed, however, to solve the above-mentioned disadvantages. This technique will be explained below with reference to FIG. 3.

As shown in FIG. 3, a cooling material or a cooling compound 6 is used in addition to the adhesive 4. The cooling compound is inserted between the cooling board 3 and the rear surface of the resistance substrate 1, in an area corresponding to the area on the front surface of the resistance substrate 1 in which the heating elements 2 are formed. Two long grooves 5 are formed in the cooling board 3 in the same direction in which the heating elements 2 are arranged. The adhesive 4 for adhering the resistance substrate 1 to the cooling board 3 is positioned at both sides of the cooling compound 6, bordering on the grooves 5.

The cooling compound 6 is preferably a mixture of silicon oil and fine particles of aluminum oxide or zinc oxide of a size of 1 μm or less. This results in a viscous cooling compound 6 with a thermal conductivity preferably in the range of $1.5\times10^{-3}$ to $3.0\times10^{-3}$ cal/cm-sec-°C. Thus, the cooling compound 6 has a thermal conductivity 3 to 6 times that of the adhesive 4 of the foregoing prior art.

After applying the cooling compound 6 on the cooling board 3 between the long grooves 5, the cooling compound 6 is compressed and evenly spread when the resistance substrate 1 is pressed on the cooling board 3. The gaps provided by the long grooves 5 allow the cooling compound 6 space to spill over, assuring that its thickness will remain even.

However, the prior art as illustrated in FIG. 3 has a disadvantage that the entire cooling board 3 must be removed from the resistance substrate 1 and the driving substrate 30 in order to correct any problems. These problems include when an air bubble is formed in the adhesive 4 or the cooling compound 6, when the resistance substrate 1 is adhered to the cooling board 3 but the adhesive 4 or the cooling compound is not evenly deposited, or when the cooling compound 6 must be again deposited again after the resistance substrate and the cooling board have already been connected.

SUMMARY OF THE INVENTION

The present invention overcomes the problems and disadvantages of the prior art by providing a thermal print head which includes a cooling board separable into two parts. The separable cooling board is easily repaired or replaced when the cooling board is not firmly adhered to the resistance substrate or the driving substrate, or if the cooling compound is incorrectly inserted.

To achieve the objects and in accordance with the purpose of the invention, as embodied and broadly described herein, the thermal print head includes a resistance substrate having a front and rear surface; a plurality of heating elements for converting electrical energy into heat energy, formed on the front surface of the resistance substrate; a cooling board for dissipating heat generated from the heating elements and the resistance substrate, wherein the cooling board is divided into separable first and second parts, the first part being disposed opposite the rear surface of the resistance substrate and below the heating elements; and a cooling compound with high thermal conductivity inserted between the first part of the cooling board and the rear surface of the resistance substrate.

Further, the thermal print head may also include a driving substrate for driving the heating elements and the resistance. Also, the first part of the cooling board may be attached to the second part of the cooling board by a screw. The second part of the cooling board may adhered to the resistance substrate and the driving substrate by an adhesive.

Additional objects and advantages of the invention will be set forth in part in the description which follows, and will be clear from the description. The objects and advantages of the invention will be realized and attained by means of the elements and combinations particularly pointed out in the appended claims.

BRIEF DESCRIPTION OF THE DRAWINGS

The accompanying drawings illustrate embodiments of the invention and, together with the description, serve to explain the principles of the invention. In the drawings.

DESCRIPTION OF A PREFERRED EMBODIMENT

Reference will now be made in detail to a preferred embodiment of the present invention, an example of which is illustrated in the accompanying drawings. Wherever possible, the same reference numbers will be used throughout the drawings to refer to the same or like parts.

Figure 1:
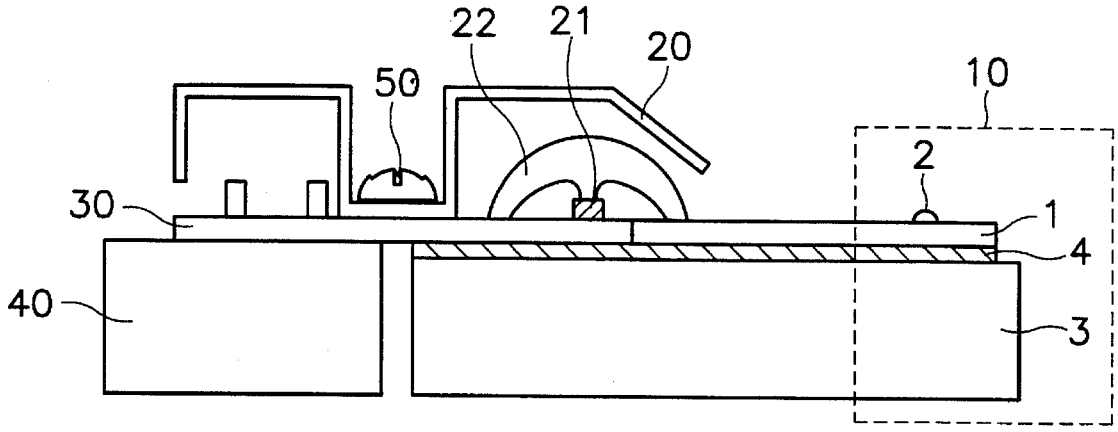
FIG. 1 (Prior Art)
FIG. 1 is a sectional view illustrating a conventional thermal print head.
Figure 2:
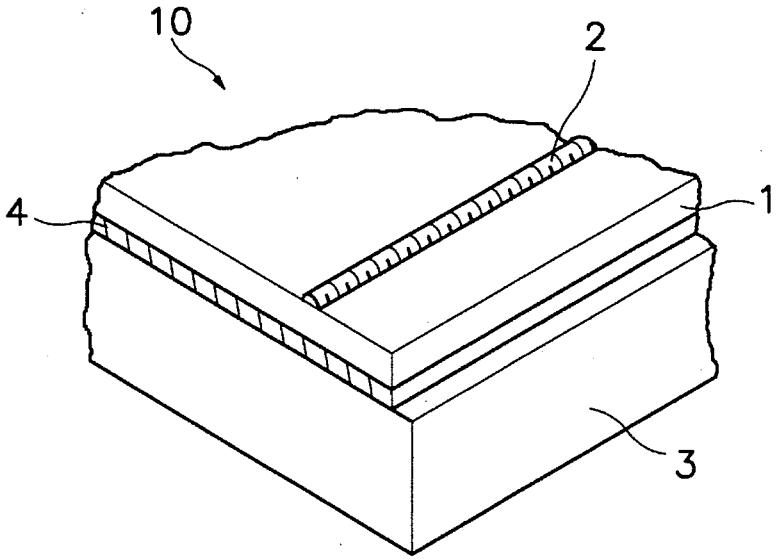
FIG. 2 (Prior Art)
FIGS. 2 and 3 are perspective views illustrating a part corresponding to a reference number, 10 of FIG. 1.
Figure 3:
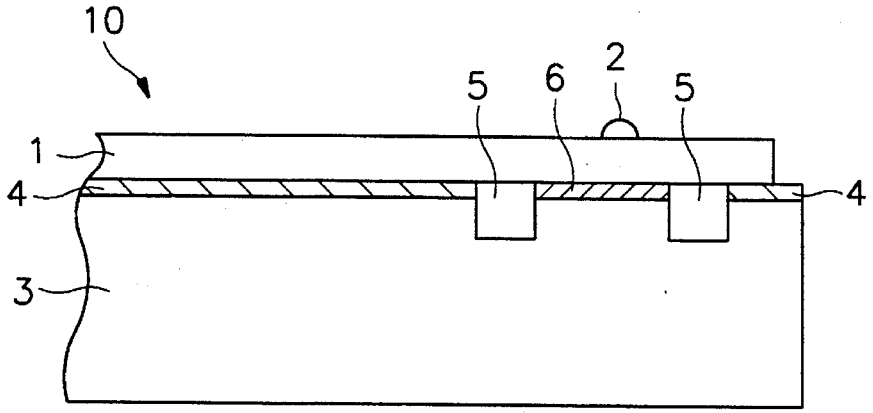
FIG.3 (Prior Art)
Figure 4:
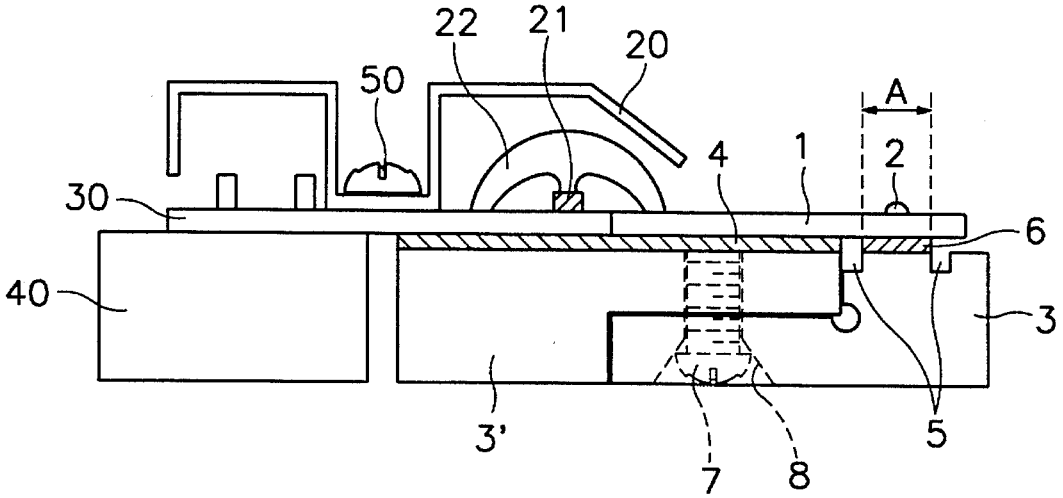
FIG. 4 is a sectional view illustrating a thermal print head according to a preferred embodiment of the present invention.

FIG. 4 is a sectional view illustrating a thermal print head according to a preferred embodiment of the present invention and is a sectional view illustrating a first part of the cooling board of FIG. 4.

A plurality of heating elements 2 for converting electrical energy into heat energy are formed on a front surface of a resistance substrate 1. The resistance substrate 1 is a rigid panel having electrically insulating characteristics. It is preferably formed out of an alumina ceramic or any substance with similar properties. The heating elements 2 are formed linearly on the resistance substrate, similar to a row of dots. A rear surface of the resistance substrate 1 is divided into two regions. The first region, designated A in FIG. 4, corresponds to the area of the front of the resistance substrate 1 upon which the heating elements 2 are formed. The second region includes the remainder of the resistance substrate 1.

Figure 5:
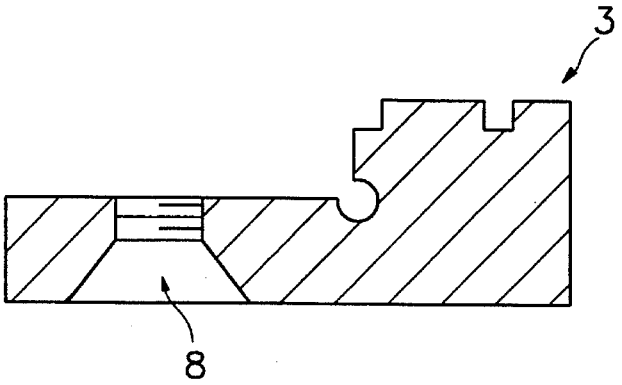
FIG. 5 is a sectional view illustrating a first part of the cooling board shown in FIG. 4, according to a preferred embodiment of the present invention.

First and second cooling boards 3 and 3' are made of light alloy material such as aluminum alloy and are formed opposite the rear surface of the resistance substrate 1. The first cooling board 3 includes a part corresponding in size and location to the first region A of the resistance substrate 1. A screw hole 8 is formed in the first and second cooling boards 3 and 3', and the two cooling boards 3 and 3' can be jointed by a screw. It is preferable that the first cooling board 3 be made as illustrated in FIG. 5.

A cooling compound 6 with high thermal conductivity is inserted between the first region A of the rear surface of the resistance substrate 1 and the first cooling board 3. Preferably silicon grease is used as the cooling compound 6, although any appropriate tacky agent with a high thermal conductivity may be used.

An adhesive 4 is inserted between the second region of the rear surface of the resistance substrate 1 and the second cooling board 3', and bonds the resistance substrate 1 to the second cooling board 3'. Preferably double-sided tape is used as the adhesive 4, although any other appropriate adhesive may be used.

Two grooves 5 are formed in a principal plane of the first cooling board 3. The grooves 5 are formed between the first region A and the second region of the resistance substrate 1, and serve to separate the cooling compound 6 from the adhesive 4. Although two grooves are used in the preferred embodiment, a single groove or greater than two grooves may also be used as needed.

In addition, the thermal print head according to the preferred embodiment of the present invention includes a driving substrate 30 and a driving integrated circuit 21 formed on the driving substrate 30. The driving integrated circuit 21 separately drives the resistance substrate 1 and the heating elements 2. A part of the driving substrate 30 is adhered to a part of the cooling board 3 by the adhesive 4, thereby supporting cooling board 3. A protector 22 protects the driving integrated circuit 21 by coating the driving integrated circuit 21. A cover 20 further protects the driving integrated circuit 21 by covering over the protector 22. The cover 20 is preferably attached to the driving substrate 30 by a screw 50.

As described above, since the cooling board can be separated in two parts, it is possible to replace or repair the cooling board by separating a part from the cooling board instead of removing the entire cooling board to repair a product when the cooling compound is deposited wrong or made wrong.

Other embodiments of the invention will be apparent to the skilled in the art from consideration of the specification and practice of the invention disclosed herein. It is intended that the specification and examples be considered as exemplary only, with the true scope and spirit of the invention being indicated by the following claims.

What is claimed is:

1. A thermal print head, comprising:

a resistance substrate having a front and rear surface;

a plurality of heating elements for converting electrical energy into heat energy, formed on the front surface of the resistance substrate;

a cooling board for dissipating heat generated from the heating elements and the resistance substrate, wherein the cooling board is divided into separable first and second parts, the first part being disposed opposite the rear surface of the resistance substrate and below the heating elements; and a cooling compound with high thermal conductivity inserted between the first part of the cooling board and the rear surface of the resistance substrate.

2. The thermal print head of claim 1, further comprising means for driving the heating elements.

3. The thermal print head of claim 2, further comprising a driving substrate for mounting the driving means, and wherein the cooling board dissipates heat generated by the driving substrate.

4. The thermal print head of claim 1, wherein the first part of the cooling board is attached to the second part of the cooling board by a fastening means.

5. The thermal print head of claim 4, wherein the fastening means is a screw.

6. The thermal print head of claim 1, wherein the second part of the cooling board is adhered to the resistance substrate by an adhesive.

7. The thermal print head of claim 6, wherein the adhesive is a double-sided tape.

8. The thermal print head of claim 1, wherein at least one groove is formed on the first part of the cooling board, proximate to the cooling compound.

9. A thermal print head, comprising:

a resistance substrate having a front surface and a rear surface, wherein a first region and a second region exist on the rear surface;

a plurality of heating elements for converting electrical energy into heat energy formed on the front surface of the resistance substrate opposite the first region on the rear surface;

a first cooling board disposed opposite the first region on the rear surface of the resistance substrate;

a second cooling board, separable from the first cooling board, disposed opposite the second region of the rear surface of the resistance substrate;

a cooling compound disposed between the first region of the rear surface of the resistance substrate, and the first cooling board, the cooling compound having a high thermal conductivity; and an adhesive disposed between the second region of the rear surface of the resistance substrate and the second cooling board.

10. The thermal print head of claim 9, wherein the first and second cooling boards are designed to fit together in an interlocking fashion.

11. The thermal print head of claim 9, wherein the first cooling board is attached to the second cooling board by a fastening means.

12. The thermal print head of claim 11, wherein the fastening means is a screw.

13. The thermal print head of claim 9, wherein double-sided tape is used as the adhesive.

14. The thermal print head of claim 9, wherein at least one groove is formed in a principal plane of the first cooling board, and the groove is formed between the first and second cooling boards to separate the cooling compound from the adhesive.

* * * * *